US006226924B1

(12) United States Patent
Kuzub

(10) Patent No.: US 6,226,924 B1
(45) Date of Patent: May 8, 2001

(54) SEALING RAIL CAR DOOR

(75) Inventor: Danny Kuzub, Regina (CA)

(73) Assignee: Degelman Industries Ltd., Regina (CA)

( * ) Notice: Subject to any disclaimer, the term of this patent is extended or adjusted under 35 U.S.C. 154(b) by 0 days.

(21) Appl. No.: 09/399,317

(22) Filed: Sep. 20, 1999

(51) Int. Cl.[7] ..... E05D 15/10
(52) U.S. Cl. ..... 49/220; 49/218; 49/35
(58) Field of Search ..... 49/208, 209, 211, 49/216, 218, 219, 220, 221, 223, 225, 360, 394, 395, 35; 292/3, 32, 34, 37, 62

(56) References Cited

U.S. PATENT DOCUMENTS

| | | | | |
|---|---|---|---|---|
| 3,720,020 | * | 3/1973 | Bollinger | 49/220 X |
| 3,788,007 | | 1/1974 | Bailey . | |
| 3,820,283 | | 6/1974 | Accerra et al. . | |
| 3,978,618 | | 9/1976 | Malo . | |
| 4,048,755 | * | 9/1977 | Wolak et al. | 49/225 X |
| 4,064,810 | * | 12/1977 | Jenkins et al. | 49/220 X |
| 4,091,570 | | 5/1978 | Favrel . | |
| 4,114,935 | | 9/1978 | Malo . | |
| 4,170,845 | * | 10/1979 | Owen | 49/220 |
| 4,296,956 | | 10/1981 | Colombo . | |
| 4,608,777 | | 9/1986 | Okamoto . | |
| 4,751,793 | | 6/1988 | Jenkins et al. . | |
| 4,763,385 | | 8/1988 | Furch et al. . | |
| 4,776,619 | | 10/1988 | Daugherty et al. . | |
| 4,852,918 | | 8/1989 | Allen . | |
| 5,056,835 | | 10/1991 | Johnson . | |
| 5,142,823 | | 9/1992 | Brandenburg et al. . | |
| 5,302,072 | | 4/1994 | Stauffer et al. . | |
| 5,467,558 | * | 11/1995 | Kober et al. | 49/220 |

* cited by examiner

*Primary Examiner*—Jerry Redman
(74) *Attorney, Agent, or Firm*—Adrian D. Battison; Murray E. Thrift

(57) ABSTRACT

A sliding door arrangement comprises a door which is slidably moved and is arranged to enclose an opening, a rail assembly coupled to the door allows the slidable movement of the door for opening and closing the opening and a securing mechanism which pulls the door inward so that the door engages the opening. The rail assembly has a rail system which is positioned at a top end and at a bottom end of the door and the rail system is mounted on a housing, a plurality of guides coupled to the door, the guides engage the rail assembly such that the door is slidable in a substantially horizontal direction. At least one shaft having a vertical axis is rotated about the vertical axis by the securing mechanism, the shaft has first end and a second end such that each end is respectively coupled to the rail assembly, the rail assembly has a rail system which is positioned at a top end and at a bottom end of the door and are mounted on a housing. A cam is mounted to a first end and a second cam is mounted to a second end of at least one vertical shaft and each cam is coupled to one guide of the plurality of guides, the cams are substantially coaxial and are parallel to a vertical axis of the shaft, each cam is mounted respectively to the guides wherein the vertical axis of the cams are off set in respect to the vertical axis of the shaft such that the shaft is arranged to rotate about the vertical axis of the cam, a first rotation of the shaft forces the door into the opening and a second rotation of the shaft forces the door away from the opening while the guides remain on the rail system, the shaft is driven by a rotation device of the securing mechanism, the rotation device pivots about a generally vertical axis such that a drive mechanism which extends outwardly substantially perpendicular to the axis of the rotation device and is coupled to the shaft.

10 Claims, 7 Drawing Sheets

79
91
81
95
93
15
83
99
19
45
85
97
87
39
89
41

SEALING RAIL CAR DOOR

FIELD OF THE INVENTION

The present invention relates to a door for a rail car which is located on a train. More specifically the door is arranged to tighten towards the rail car so that the door is sealed and locked.

BACKGROUND OF THE INVENTION

Freight, box, rail cars and the like are used to transport items across distances which vary in environment and topography. The doors on rail cars are generally mounted on rails which allow a door to slide horizontally to allow access to the inside of the rail car or to restrict access to the inside of the rail car. These doors are relatively large in stature and are made of metal since the loads carried within the rail cars can be large so the doors must be able to accept large items. The doors must also be durable due to the movement of the items within the rail car during transportation and due to the conditions surrounding the rail car during transportation. The conditions can consist of the elements such as rain, snow, wind and other weather conditions which can damage the items, and the conditions can consist of animals such as rodents entering the rail car which also can damage the items. A rail car door must also be able to be locked so that the items within the car are protected from theft and the like.

Some examples of doors of this type are found in U.S. Pat. No. 3,978,618 (Malo), U.S. Pat. No. 4,114,935 (Malo), U.S. Pat. No. 4,608,777 (Okamoto), U.S. Pat. No. 4,751,793 (Jenkins et al), U.S. Pat. No. 3,788,007 (Bailey), U.S. Pat. No. 4,091,570 (Favrel) and U.S. Pat. No. 5,142,823 (Brandenburg et al) which in general disclose a sliding door or the like arranged to enclose an area such as a rail car, each door being relatively unique in design but each does not adequately enclose the rail car door or the like. The doors do not seem to create a seal about an entrance so that water or the like may not enter, so that if a load such as paper is being hauled within the car, it is not protected and could be damaged. The doors have a locking device for locking the door either to close or to open an entrance.

Some examples of locking devices are shown in U.S. Pat. No. 4,852,918 (Allen), U.S. Pat. No. 4,763,385 (Furch et al), U.S. Pat. No. 3,820,283 (Acerra et al), U.S. Pat. No. 4,776,619 (Daugherty et al), U.S. Pat. No. 4,296,956 (Colombo) U.S. Pat. No. 5,056,835 (Johnson) and U.S. Pat. No. 5,302,072 (Stauffer et al).

There is a need for a rail car door which is creates a seal about the entrance, creating a complete seal by around such a large area by a large door is difficult. A door needs to be designed to ride on rails, as generally known, and needs to be able to be moved a relatively large distance inward by a relatively small force to create a seal on at the entrance.

SUMMARY OF THE INVENTION

According to one aspect of the invention there is provided a sliding door arrangement comprises;

- a door which is slidably moved and is arranged to enclose an opening;
- a rail assembly coupled to the door allows the slidable movement of the door for opening and closing the opening;
- and a securing mechanism which pulls the door inward so that the door engages the opening.

Preferably the rail assembly has a rail system which is positioned at a top end and at a bottom end of the door and the rail system is mounted on a housing, a plurality of guides coupled to the door, the guides engage the rail assembly such that the door is slidable in a substantially horizontal direction.

Preferably at least one shaft having a vertical axis is rotated about the vertical axis by the securing mechanism, the shaft has first end and a second end such that each end is respectively coupled to the rail assembly, the rail assembly has a rail system which is positioned at a top end and at a bottom end of the door and are mounted on a housing.

Preferably the securing mechanism has a rotation device, the rotation device pivots about a vertical axis such that a drive mechanism which extends outwardly substantially perpendicular to the axis of the rotation device and is coupled to a shaft which is generally parallel to the vertical axis of the rotation device.

Preferably a cam is mounted to a first end and a second cam is mounted to a second end of at least one vertical shaft and each cam is coupled to one guide of the plurality of guides, the cams are substantially coaxial and are parallel to a vertical axis of the shaft, each cam is mounted respectively to the guides wherein the vertical axis of the cams are off set in respect to the vertical axis of the shaft such that the shaft is arranged to rotate about the vertical axis of the cam, a first rotation of the shaft forces the door into the opening and a second rotation of the shaft forces the door away from the opening while the guides remain on the rail system, the shaft is driven by a rotation device of the securing mechanism, the rotation device pivots about a generally vertical axis such that a drive mechanism which extends outwardly substantially perpendicular to the axis of the rotation device and is coupled to the shaft.

Preferably two shafts are located at respective sides of the door, each shaft having a parallel vertical axis, a rotation device is arranged to rotate each shaft about the respective vertical axis, a drive mechanism is coupled to the rotation device and extends substantially perpendicular to the axis and is coupled to each of the shafts for rotating each shaft, the shafts have a cam at a top and bottom end for engaging the rail assembly, each cam is arranged to be mounted generally at a corner of the door and the respective top and bottom cams are coaxial and parallel to the shaft, the axis of the respective cams are off set to the shafts so that when the shafts are simultaneously rotated by the drive mechanism the shafts rotate about the axis of the cams which forces the door to engage the opening and when the cams reach a top dead centre the door is at its tightest position against the opening when locked.

Preferably the securing mechanism locks the door in the closed position and locks the door when in the open position.

Preferably the securing mechanism is located within the door for protection.

Preferably a receptacle is arranged to receive the door when opened and when closed.

Preferably the rail assembly has a rail system which is positioned at a top end and at a bottom end of the door and are coupled to a housing, the rail system is arranged to be self cleaning such that when the door moves along the rail system a scraping mechanism coupled to the door scrapes the rail system clearing any unwanted materials such as dirt and the like.

Preferably the rotation device is a handle.

Preferably the rotation device is a card activated lock system, a card is used to activate the lock system such that the drive mechanism rotates the shaft, a vertical shaft, defining a worm, which engages a horizontal shaft of the drive mechanism, defining a wheel, the horizontal shaft extends outwardly and has an outer end, defining a second worm, which engages a drive portion of the shaft, defining a second wheel.

Preferably the drive mechanism is a chain which is driven to rotate the shaft.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

A sliding door 1 is mounted a rail car 3 or the like for allowing access to the rail car through an opening 5 for storing and transporting goods and materials. The door is arranged to enclose the car by covering the opening and locking so that the car is sealed. A seal at the opening is important especially if the goods which are being transported cannot be exposed to the elements. For instance when transporting stereo components or furniture, dust or water can severally damage the products, also theft is considered a major problem for distributors and the like since the products can be stolen when the train is stopped for loading or unloading and the like.

The door is also arranged to be lockable in the open position as well as in the closed position. Locking the door in the open position will help prevent accidents which involve the door closing when workers are loading the car. These accidents, generally, happen because of connecting more car to the train while some cars are being unloaded since the force of a car attaching to the train causing the train to jerk slightly which can cause the door to close. Many times an operator is located in the opening when the door accidentally closes which can harm the worker.

Figure 1:
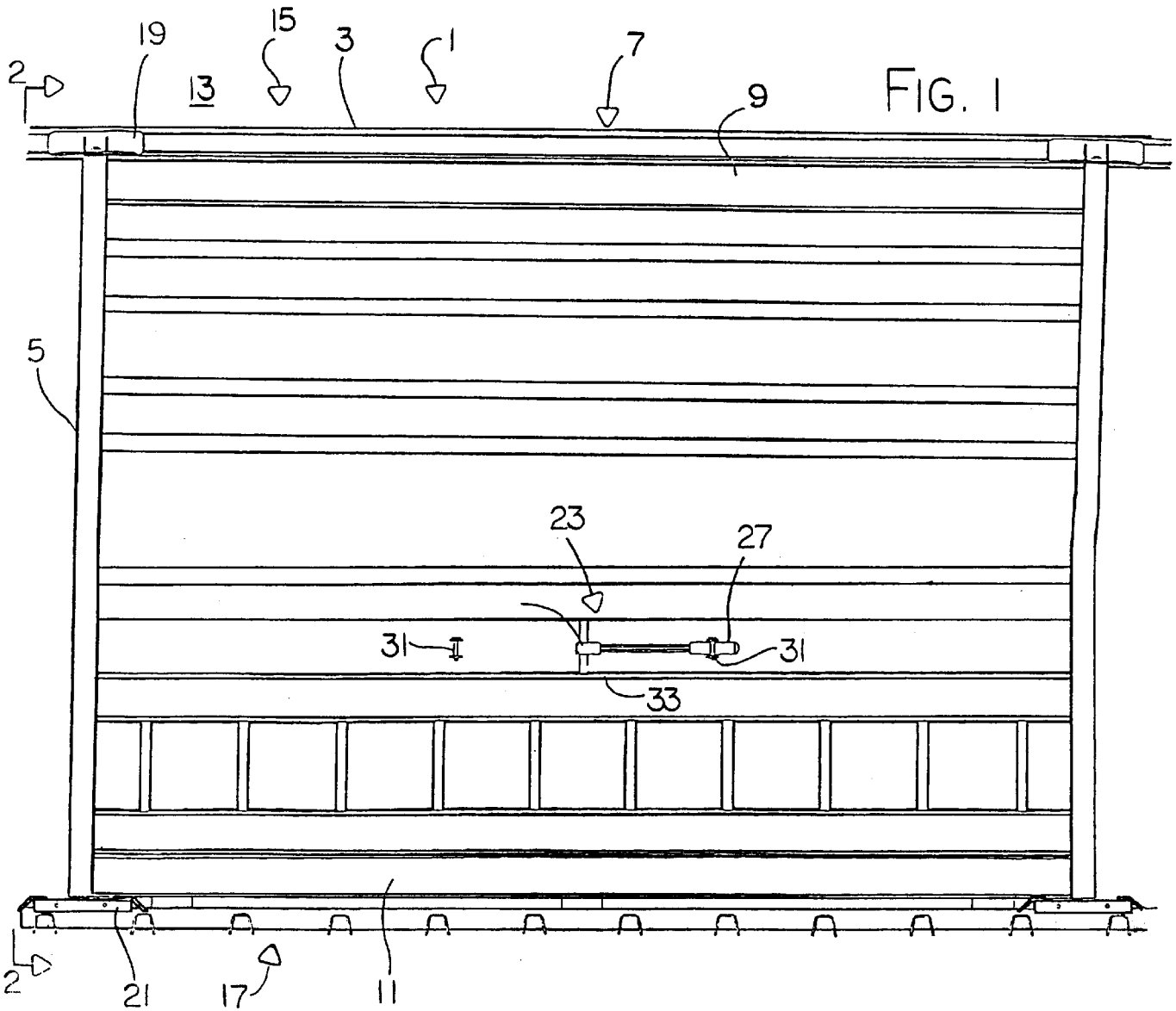
FIG. 1 is a front elevational view of the present invention.

FIG. 1 shows front view of the door in the closed position on the rail car. The door is supported on the rail car by a rail assembly 7 which is located at a top end 9 and a bottom end 11 of the door and is coupled to a housing 13 of the rail car. The rail assembly comprises a first rail system 15 and a second rail system 17. The first rail system 15 is located above the door and extends horizontally on the housing and is arranged to receive a first set of guides 19 which are coupled to the door for connecting the door to the first rail system. The second rail system 17 is located below the door and extends horizontally on the housing parallel to the first rail system and is arranged to receive a second set of guides 21 which are coupled to the door for connecting and supporting the door to the second rail system. The second rail system is arranged to support most of the weight of the door and the first rail system is arranged to support the vertical stature of the door, as described later in detail.

The door is locked by a securing mechanism, generally indicated by, 23. The securing mechanism comprises a rotation device 25 which has a first position 27, shown in FIG. 1, and a second position, not shown. In the first position the rotation device, as shown in FIG. 1, is a handle 29 which is locked in position by a lock 31 so that the door is secured in the closed or opened position. A pad lock or the like can be attached to the lock for added security from theft and the like.

Figure 2:
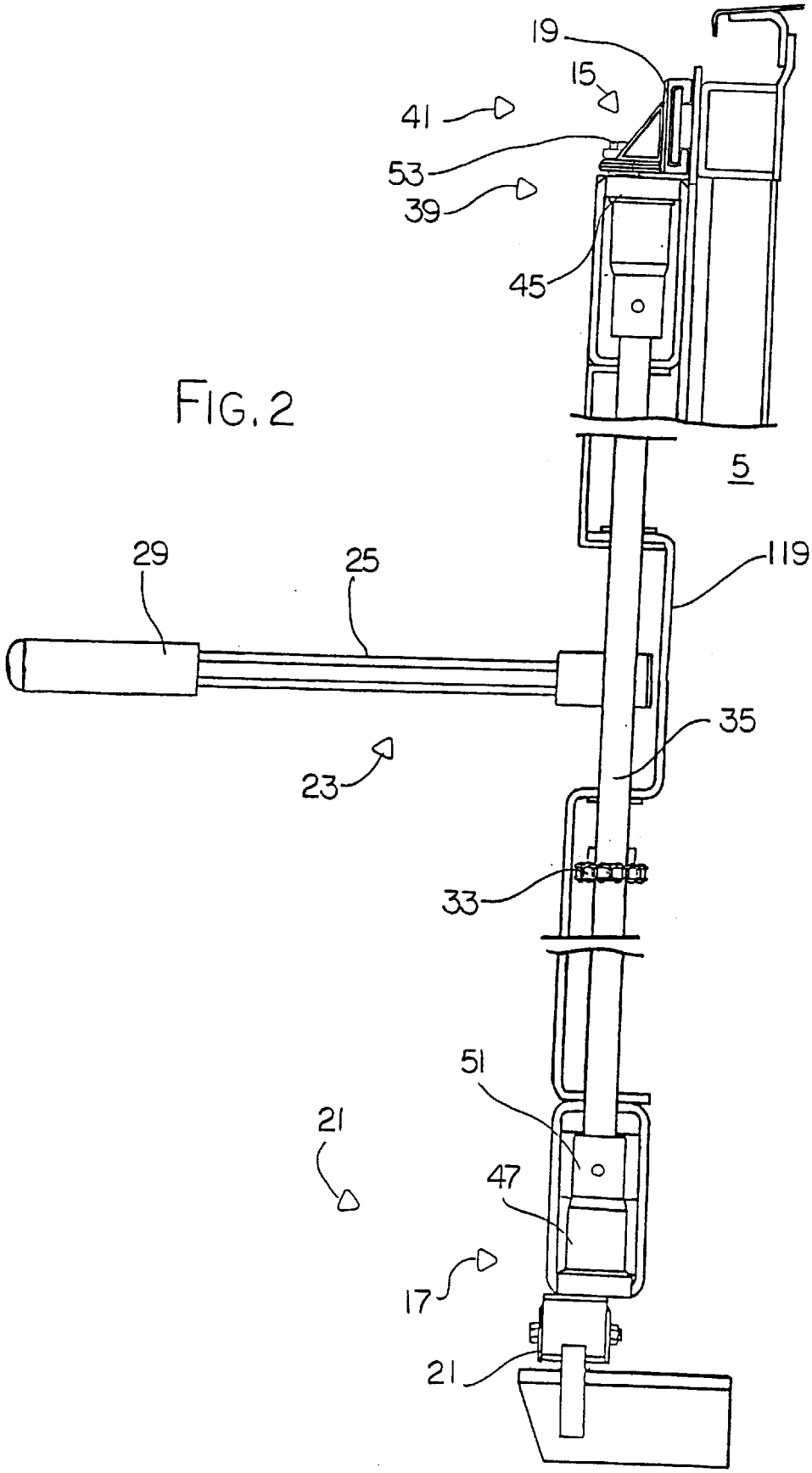
FIG. 2 is a partial vertical cross section along the lines 2—2 in FIG. 1 showing the top, middle and bottom portions of the present invention.

FIG. 2 shows the securing mechanism of the door. The door also has a construction which has a plurality of channels 119 for added strength to the door. The doors are designed to be light in weight yet still be strong enough to receive a fork from a fork lift or the like. The door has a bar, not shown, which is arranged such that the doors can be opened by a fork lift or the like for loading and unloading. The securing mechanism comprises the rotation device, as mentioned above, a drive mechanism 33 and a vertical shaft 35. The drive mechanism is arranged to rotate the shaft about an axis 37. The drive mechanism is coupled to the rotation device such that movement of the rotation device actuates the drive mechanism, the rotation device pivots about a vertical axis which rotates a drive shaft having a wheel which engages the drive mechanism which extends horizontally from the drive shaft.

The shaft is located at a respective end of the door and has a cam arrangement 39 at a top end 41 and at a bottom end 43. The cam arrangement is mounted to the rail assembly at respective ends of the shaft. The cam arrangement consists of a first cam 45 mounted on the top end and a second cam 47 mounted on the bottom end such that the cams are coaxial. The cams have a vertical axis 49 which is parallel to the axis of the shaft. A housing 51 of the cam arrangement is mounted on the shaft for supporting the cams to the shaft. The cams are arranged to rotate on the vertical axis 49 when the shaft is rotated by the drive mechanism. The axis of the shaft rotates about the vertical axis of the cams which moves the shaft inward or outward relative to the direction of the drive mechanism. The housing is arranged to engage the rail car at an outer edge of the opening for sealing the door on the car. When the shaft is rotated in a forward direction by the drive mechanism, the cam which is mounted to the rail system by a cam shaft 53 at an outer edge 55 of the rail system, as described in detail later, the shaft rotates about the axis of the cam so that the shaft moves inward towards the car such that the cam is at a top dead center position when fully engaging the door for a constant sealing of the opening. The rotating device is at that point engaging the door so that the lock can be applied to the handle for locking the door in place.

Figure 3:
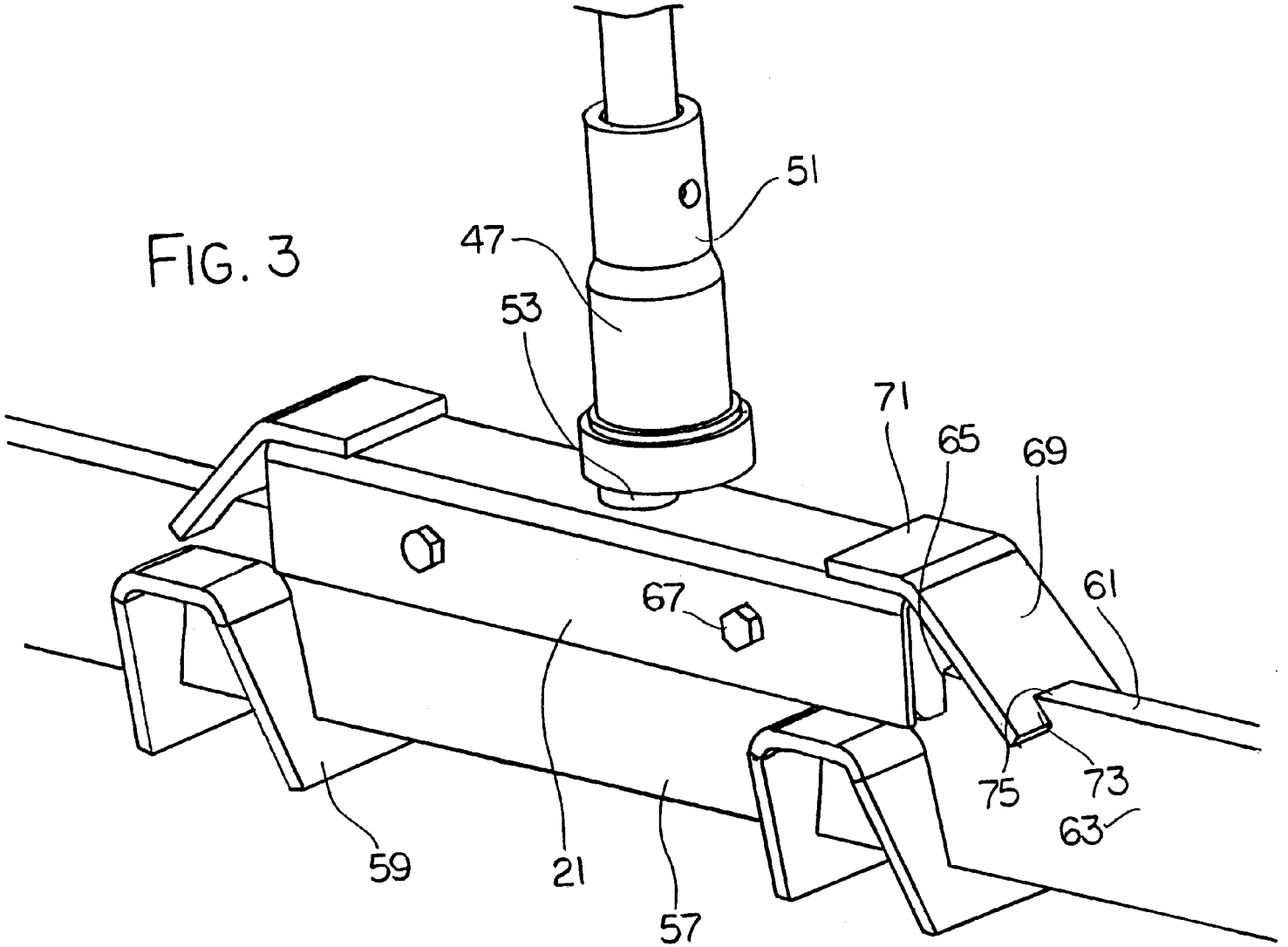
FIG. 3 is an isometric view of the bottom portion of the present invention.

FIG. 3 shows the second cam at the bottom end of the shaft. The axis of the cam is parallel to the axis to the shaft but is arranged to be off set in manner such that the shaft rotates about the vertical axis of the cam.

The rail system at the bottom end of the shaft is shown in FIG. 3, wherein the rail system includes a rail 57 and rail support arms 59. The rail has a two first sides 61, defining a top and bottom side, and a second side 63, defining front and back sides. The first side is smaller in width than the second side, the rail support arms are attached to the second sides and are substantially U-shaped and are mounted to the car so that the rail is located slightly away from the side of the car for movement of the door. The second guide 21 is located on the top side and has a channel 65 which is substantially U-shaped for receiving the rail. The rail has wheels located within the guide at the channel for movement along the rail, which are fastened by bolts 67 which show the general location of the wheels. A scraping device 69 is attached to the guide and is arranged to scrape any unwanted materials from the rail so that movement of the door is unhindered. The scraping device is located at respective ends of the guide and is attached to the guide at a top end 71 and extends downwardly at an incline and engages the rail at a bottom end 73 which has a substantially U-shaped slot 75 in which the rail is received such that the top side and the a portion of the second sides are scraped to remove material on the rail. The guide is mounted on the rail so that is moveable in a side to side direction, defining the sliding movement of the door, so that when the door is pulled inward against the car the guide is positioned stationary which allows the door to seal the opening.

Figure 4:
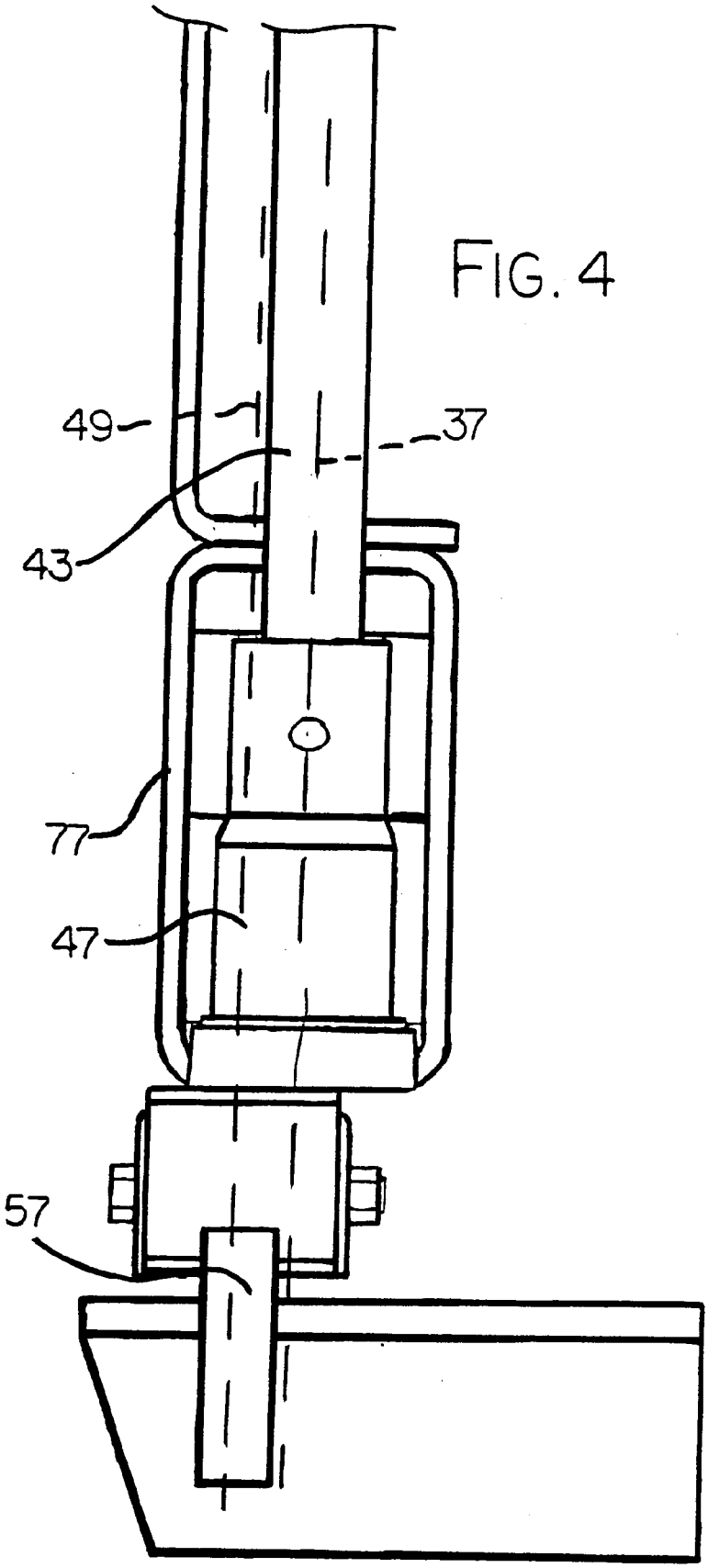
FIG. 4 is a vertical cross section along the lines 2—2 in FIG. 1 showing the bottom portion only.

FIG. 4 shows the bottom end of the shaft. The door has a housing 77 in which the shaft is located. The housing covers the cam so that the majority of the securing mechanism is located within the door for protection against the elements.

Figure 5:
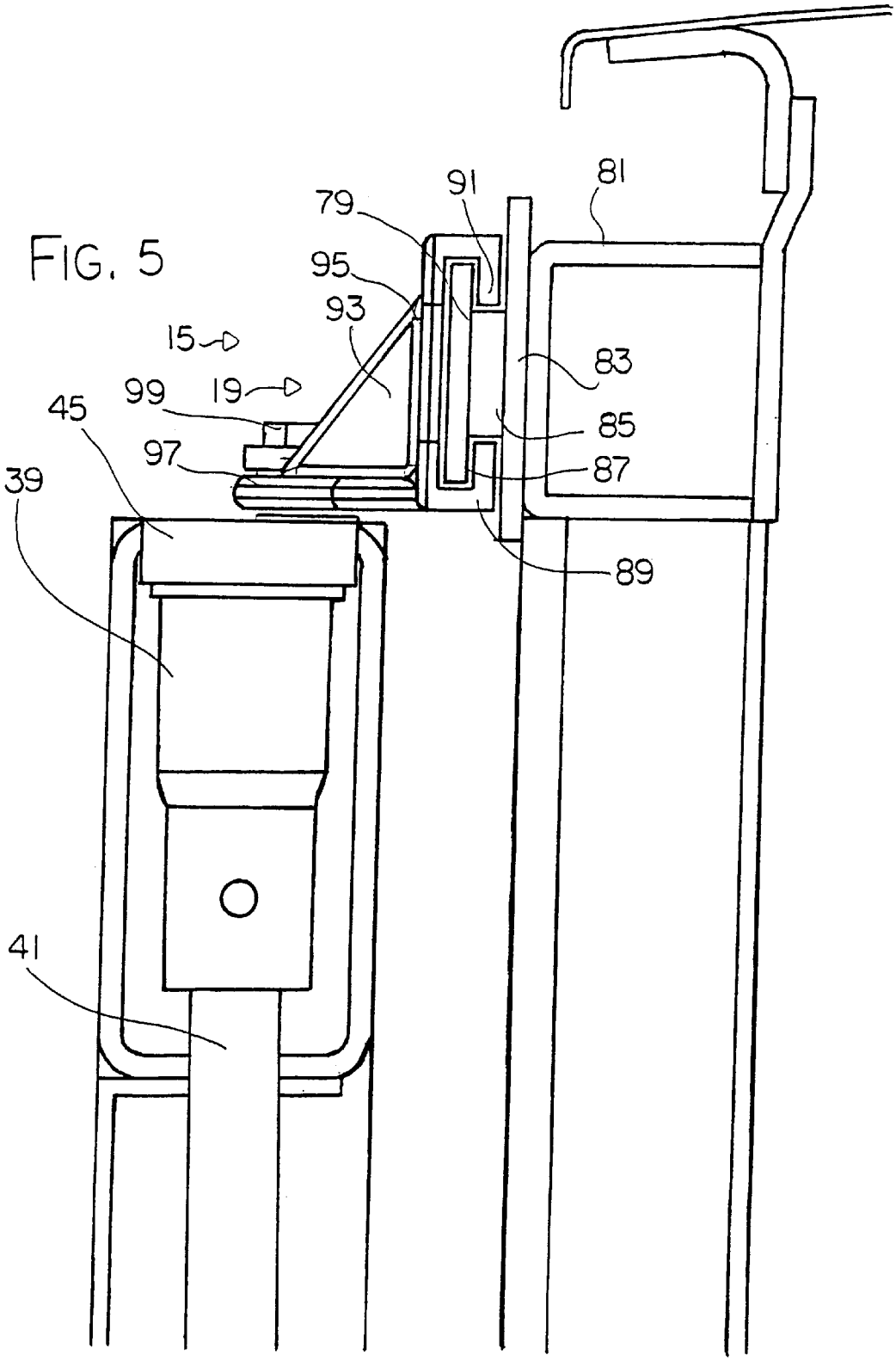
FIG. 5 is a vertical cross section along the lines 2—2 of FIG. 1 showing the top portion only.

FIG. 5 shows the top end of the shaft and the first rail system. The first rail system includes a rail 79 which is mounted parallel to the rail at the second rail system on a rail bar 81 of the car. The rail is vertically mounted and extends horizontally along the car. The rail is substantially H-shaped wherein a first portion 83 attached to the rail bar, an abutment 85 extending outwardly from the centre line of the first portion and an outer edge 87 parallel to the first portion on the abutment in which the first guide is located. The first guide consists of a C-shaped mount portion 89 which is mounted on the outer edge 87 of the rail. The mount portion is arranged to surround the outer edge and has a top and bottom flange 91 which is adjacent to the abutment such that the guide is limited in movement away and towards the door. An angle portion 93 is attached to the back side 95 of the mounted portion wherein a cam mount ledge 97 is located. The cam mount ledge is arranged such that the cam shaft can be attached by a bolt 99 for rotation on the axis. The first cam is located within the housing of the door such that when the securing mechanism is engaged in the lock position the housing engages the opening of the car for creating a seal. The first cam in FIG. 5 is in the unlock position wherein the cam is located at top dead centre away from the car so the door can be slide away for access to a interior of the car for loading and the like.

Figure 6:
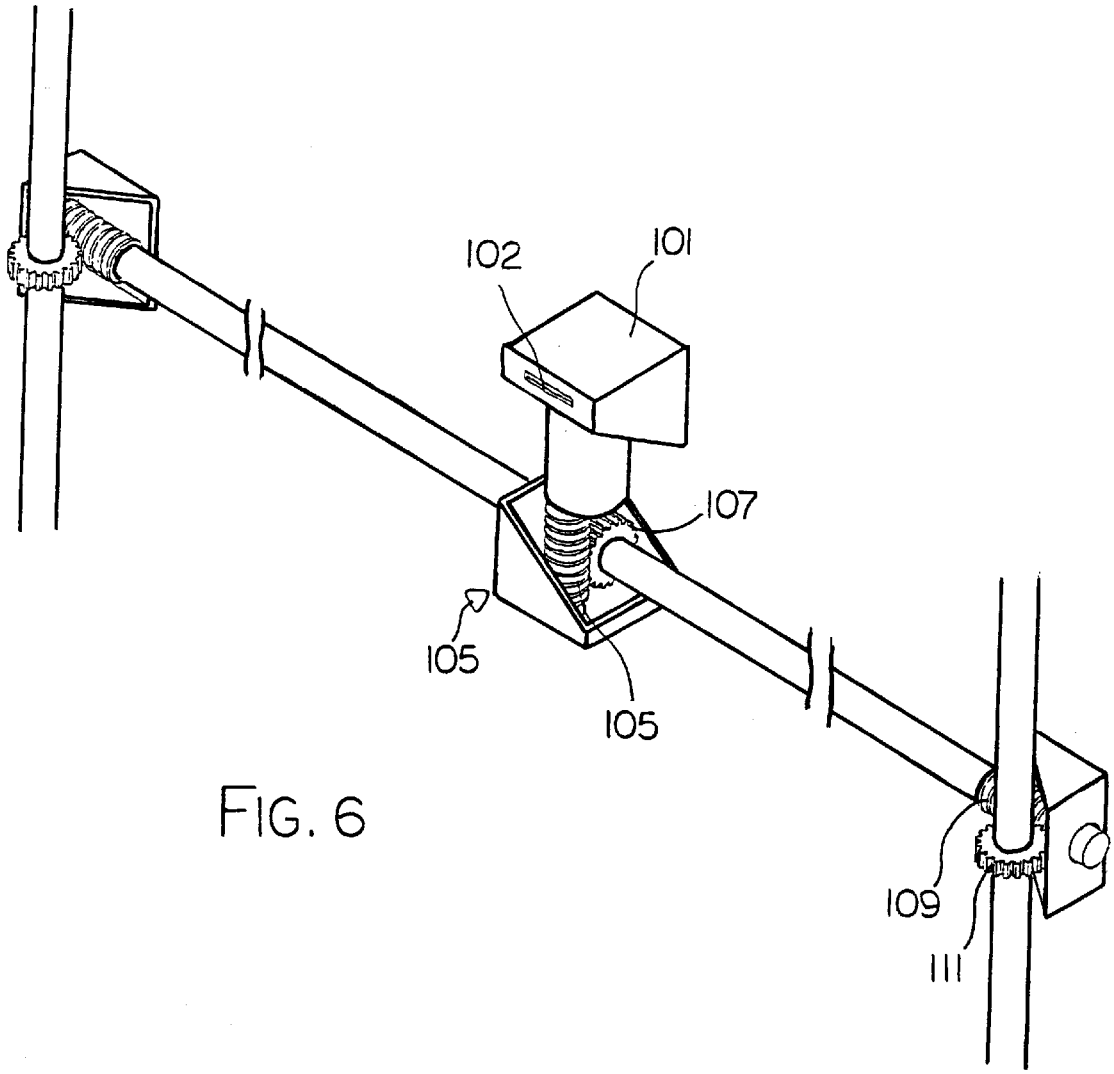
FIG. 6 is a cut away partial isometric view of a second locking arrangement of the present invention.

FIG. 6 shows another embodiment of the rotation device wherein a card lock 101 is utilised so that a card inserted into a slot 102 actuates the rotating device to lock or unlock the securing mechanism. A wheel and worm combination 103 is utilised which comprises a first worm 105 on the rotation device engages a first wheel 107 of the drive mechanism. The first wheel is rotated by a mechanism within the card lock so that the first wheel is driven about a horizontal axis. The first wheel is coupled to a horizontal shaft which is rotated about the horizontal axis when the card lock is actuated. At respective ends of the shaft is a second wheel 109 which engages a second worm 111 on the shaft. Rotation of the horizontal shaft drives the second wheel such that the shaft is rotated about the axis of the cam, as mentioned above. The horizontal shaft including the wheel and worm combination is located within the housing of the door for protection from the elements.

Figure 7:
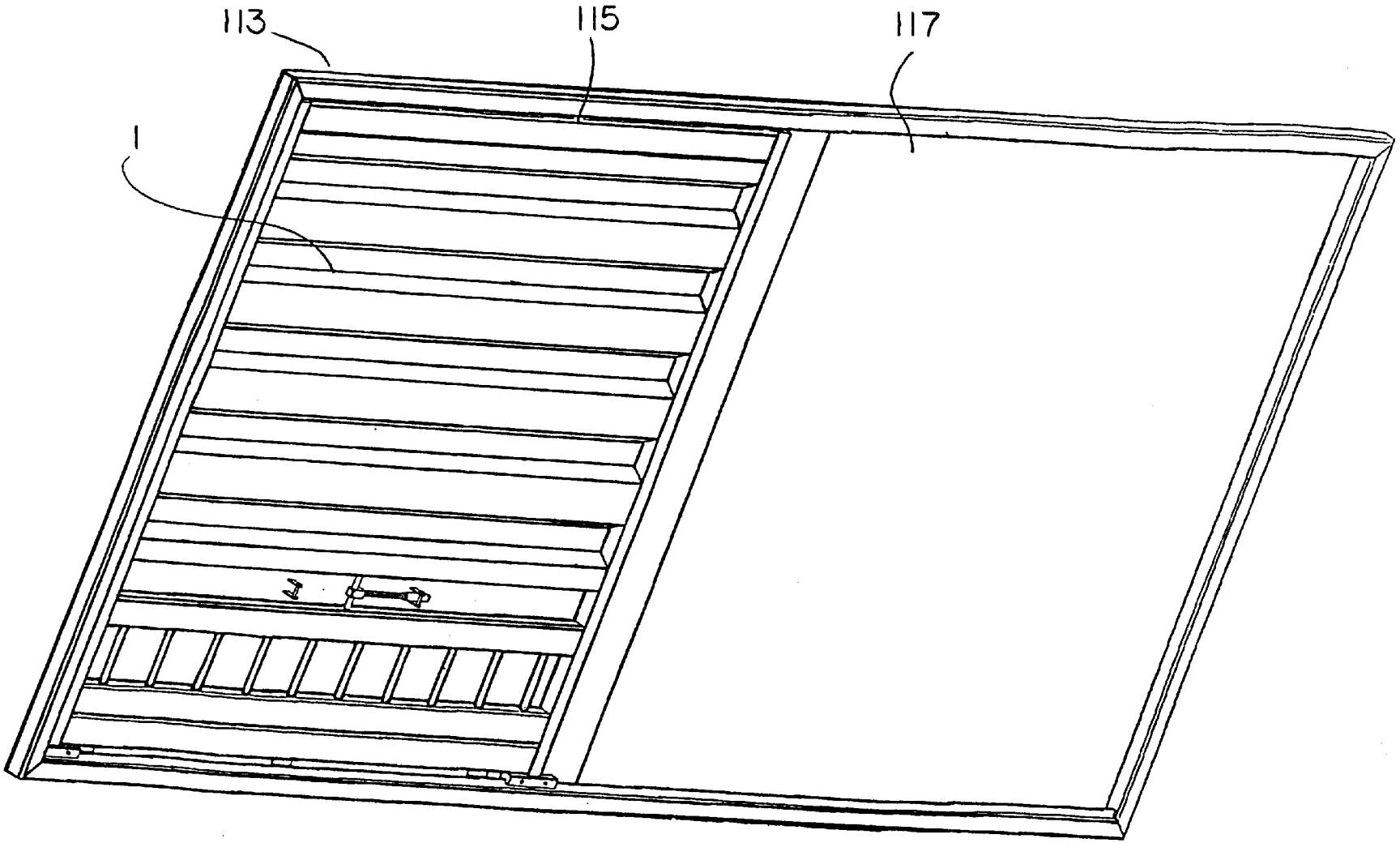
FIG. 7 is a front elevational view of the receptacle in which the door is located in another embodiment.

In another embodiment, the door is mounted within a receptacle 113, as shown in FIG. 7. The receptacle is arranged such that the door is located on the car and such that the door is inline with the cars walls and does not hang out of the perimeter of the car. The receptacle has a first portion 115 which is arranged to receive the door when the door is closed and a second portion 117 which is arranged to receive the door when the door is open. The receptacle is arranged such that the doors are located within the receptacle so as to prevent the doors from swinging open acting as a stopper. The doors are arranged to move out of the receptacle when being open and closed.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

What is claimed is:

1. A sliding door arrangement comprising:

a rail system at an opening, the rail system having a top rail and a bottom rail horizontally orientated and located at a top side and a bottom side respectively of the opening;

the door having a housing which is arranged to dose upon the opening;

a rail assembly coupled to the housing and connected to the rail system and including a top rail member at the top side which runs along the top rail and bottom rail member at the bottom side of the housing which runs along the bottom rail such that the housing moves in a generally horizontal direction on the rail system for opening and closing the opening;

a rigid frame within the housing for providing structure to the housing;

and a securing mechanism which is arranged to pull the door inward towards the opening for engagement thereon, the securing mechanism having:

a shaft generally vertical in orientation located within the housing on the frame;

a pair of cams within the housing each arranged on a respective end of the shaft for guiding rotation of the shaft about a longitudinal axis of the shaft;

each end of the shaft having an actuating shaft portion which extends from an end of the shaft within the cam axially of the shaft and aligned with the shaft, the shaft portion being directly connected to the respective rail member and offset from the axis of the shaft such that rotation of the shaft forces the door inwardly of the opening.

2. The arrangement according to claim 1 wherein the shaft is arranged adjacent one side edge of the door and wherein there is provided a second shaft generally vertical in orientation located within the housing on the frame parallel to the shaft and adjacent a second opposed side edge, the second shaft including a pair of cams within the housing each arranged an a respective end of the second shaft for guiding rotation of the second shaft about a longitudinal axis of the shaft, each end of the second shaft having an actuating shaft portion which extends from an end of the shaft axially of the shaft and aligned with the shaft, the shaft portion being directly connected to the respective rail member and offset from the axis of the second shaft such that simultaneous rotation of the shafts by a rotation drive member forces the door inwardly of the opening.

3. The arrangement according to claim 2 wherein the rotation drive member includes a card activated lock system, a drive mechanism actuated by the lock system which acts to rotate a vertical drive shaft parallel to the shafts and located between the shafts, a worm carried on the drive shaft, a horizontal shaft carrying a wheel driven by the worm and extending from the drive shaft to an outer end at a respective one of the shafts, each outer end carrying a second worm, which engages a drive wheel of the respective shaft such that the shafts are driven simultaneously by the drive mechanism.

4. The arrangement according to claim 1 wherein the shaft portions are arranged such that, when the cams reach a top dead centre, the door is at its tightest position against the opening.

5. The arrangement according to claim 1 wherein the securing mechanism locks the door in the dosed position and locks the door when in the open position.

6. The arrangement according to claim 1 wherein the securing mechanism is located within the door for protection.

7. The arrangement according to claim 1 wherein the top and bottom rails define a receptacle which is arranged with a first portion at the opening and a second portion to one side of the opening to receive the door when open, and wherein the receptacle is arranged such that, when the door is open in the second portion, operation of the securing mechanism moves the door into a locked open position in the receptacle.

8. The arrangement according to claim 1 wherein the bottom rail member includes a scraping mechanism for operating on the bottom rail and arranged to effect a self cleaning action on the bottom rail when the door moves along the rail system thus clearing any unwanted materials.

9. A sliding door arrangement comprising:

a rail system at an opening, the rail system having a top rail and a bottom rail horizontally orientated and located at a top side and a bottom side respectively of the opening;

the door having a housing which is arranged to close upon the opening;

a rail assembly coupled to the housing and connected to the rail system and including a top rail member at the top side which runs along the top rail and bottom rail member at the bottom side of the housing which runs along the bottom rail such that the housing moves in a generally horizontal direction on the rail system for opening and closing the opening;

a rigid frame within the housing for providing structure to the housing;

and a securing mechanism which is arranged to pull the door inward towards the opening for engagement thereon, the securing mechanism having:

a shaft generally vertical in orientation located within the housing on the frame;

a pair of actuating members arranged such that rotation of the shaft forces the door inwardly of the opening;

the bottom rail member including a scraping mechanism for operating on the bottom rail and arranged to effect a self cleaning action on the bottom rail when the door moves along the rail system thus clearing any unwanted materials.

10. A sliding door arrangement comprising:

a rail system at an opening, the rail system having a top rail and a bottom rail horizontally orientated and located at a top side and a bottom side respectively of the opening;

the door having a housing which is arranged to dose upon the opening;

a rail assembly coupled to the housing and connected to the rail system and induding a top rail member at the top side which runs along the top rail and bottom rail member at the bottom side of the housing which runs along the bottom rail such that the housing moves in a generally horizontal direction on the rail system for opening and dosing the opening;

a rigid frame within the housing for providing structure to the housing;

and a securing mechanism which is arranged to pull the door inward towards the opening for engagement thereon, the securing mechanism having:

a first shaft generally vertical in orientation located within the housing on the frame adjacent one side edge of the housing;

a pair of actuating members on the first shaft arranged such that rotation of the first shaft forces the door inwardly of the opening;

a second shaft generally vertical in orientation located within the housing on the frame adjacent a second opposed side edge of the housing;

a pair of actuating members on the second shaft arranged such that rotation of the second shaft forces the door inwardly of the opening;

a rotation drive member for effecting simultaneous rotation of the shafts;

wherein the rotation drive member includes a card activated lock system, a drive mechanism actuated by the lock system which acts to rotate a vertical drive shaft parallel to the shafts and located been the shafts, a worm carried on the drive shaft, a horizontal shaft carrying a wheel driven by the worm and extending from the drive shaft to an outer end at a respective one of the shafts, each outer end carrying a second worm, which engages a drive wheel of the respective shaft such that the shafts are driven simultaneously by the drive mechanism.

* * * * *